United States Patent [19]

Ohta et al.

[11] Patent Number: 4,653,611

[45] Date of Patent: Mar. 31, 1987

[54] ELEVATOR CONTROL APPARATUS

[75] Inventors: Kazutoshi Ohta, Nagoya; Minoru Nakata, Ichinomiya, both of Japan

[73] Assignee: Mitsubishi Denki Kabushiki Kaisha, Tokyo, Japan

[21] Appl. No.: 819,807

[22] Filed: Jan. 17, 1986

[30] Foreign Application Priority Data

Jan. 21, 1985 [JP] Japan ..... 60-8667

[51] Int. Cl.[4] ..... B66B 5/02

[52] U.S. Cl. ..... 187/107

[58] Field of Search ..... 187/29

[56] References Cited

U.S. PATENT DOCUMENTS 3,792,759 2/1974 Kirsch ..... 187/29

4,056,169 11/1977 Showalter ..... 187/29 R 4,382,489 5/1983 Suzuki et al. ..... 187/29 R

*Primary Examiner*—William M. Shoop, Jr.

*Assistant Examiner*—W. E. Duncanson, Jr.

*Attorney, Agent, or Firm*—Leydig, Voit & Mayer

[57] ABSTRACT

A period of time required since the output signal of an acceleration detector for detecting an earthquake exceeds a first set level, until it reaches a second set level greater in value than the first set level, is measured, and a calculation is executed on the basis of the measured value thereby to predict the scale of the earthquake, and a resetting period of time since an elevator is brought to a stoppage operation due to the earthquake, until the stoppage operation is released, is calculated on the basis of the predicted scale of the earthquake. Thus, the period of time till the reset is automatically set is variable according to the scale of the earthquake.

5 Claims, 6 Drawing Figures

ELEVATOR CONTROL APPARATUS

BACKGROUND OF THE INVENTION

This invention relates to an elevator control apparatus capable of an earthquake mode operation, and more particularly to the automatic reset control thereof.

In an elevator, safety is secured at the occurrence of an earthquake by switching an ordinary operation to an earthquake mode operation.

FIG. 3 is a block diagram showing an example of the elevator which performs a conventional earthquake mode operation as disclosed in Japanese Patent Application Publication No. 54-9375 (corresponding to U.S. Pat. No. 3,792,759). Referring to the figure, numeral 1 designates a first control device which controls the service of the elevator, and numeral 2 a second control device which controls the earthquake mode operation through the first control device 1 when an earthquake has occurred. The second control device 2 has an acceleration detector 3 which detects the acceleration of vibrations applied to the elevator due to the occurrence of an earthquake. A first level detecting circuit 4 generates a first level detection signal $P_1$ and supplies it to the first control device 1 when an output signal from the acceleration detector 3 has exceeded a first set level $L_1$.

A second level detecting circuit 5 generates a second level detection signal $P_2$ when, after exceeding the first set level $L_1$, the output signal supplied from the acceleration detector 3 has had its amplitude decreased below a second set level $L_2$ which is lower than the first set level $L_1$. A timer circuit 6 begins timekeeping in response to the second level detection signal $P_2$, and generates a time lapse signal Q and supplies it to the first control device 1 when a predetermined period of time $T_1$ has lapsed. The acceleration detector 3 is fixed at the uppermost floor which is affected most intensely by the earthquake.

The control circuit arranged as described above operates as will now be explained. When an earthquake has occurred, vibrations on the ground become as shown in (a) of FIG. 4 by way of example. In response to these vibrations, the output signal of the acceleration detector 3 becomes as shown in (b) of FIG. 4, the vibrations being largest in the uppermost floors part of a building. Here, when the output signal of the acceleration detector 3 has risen above the first set level $L_1$ indicated in (b) of FIG. 4, the first level detecting circuit 4 detects this state and generates the first level detection signal $P_1$ at a point of time $t_1$ indicated in (b) of FIG. 4. In this case, the first set level $L_1$ is a level by which the ordinary operation of the elevator might be affected and which is preset in consideration of the individual character etc. of the building. Therefore, the generation of the first level detection signal $P_1$ indicates that the vibrations ascribable to the earthquake have approached the level which exerts influence on the ordinary running of the elevator. Accordingly, when supplied with the first level detection signal $P_1$, the first control device 1 stops the running of the cage of the elevator at the nearest floor by virtue of a normal stopping operation so as to secure safety.

Subsequently, when the vibrations attributed to the earthquake have gradually decreased until the maximum amplitude level has consequently lowered below the second set level $L_2$, the second level detector 5 is actuated to generate the second level detection signal $P_2$ at a point of time $t_2$. In this case, the second set level $L_2$ is a level at which the influence on the ordinary running of the elevator lessens and which is preset in consideration of the individual character etc. of the building. Accordingly, the generation of the second level detection signal $P_2$ signifies that the state in in which the running of the elevator is possible has been approached owing to the weakened earthquake vibrations of the building.

When the second level detection signal $P_2$ has been generated, the timer circuit 6 is triggered thereby to start its timekeeping operation. When the predetermined period of time $T_1$ has lapsed, the time lapse signal Q is generated and is fed to the first control device 1. Here, the period of time $T_1$ is set at a time interval from the point of time $t_2$ at which the amplitude of the output signal generated by the acceleration detector 3 decreases below the second set level $L_2$, till a point of time $t_3$ at which the output signal of the acceleration detector 3 becomes sufficiently small. Thus, when supplied with the time lapse signal Q, the first control device 1 executes the processing of automatically resetting the elevator in the stop state and restoring it to the ordinary operation.

However, the elevator control apparatus including the control circuit for the earthquake mode operation based on the above arrangement has a problem. The elevator in the stop state is automatically reset at the point of time $t_3$ at which the predetermined time interval $T_1$ has lapsed since the point of time $t_2$ at which the amplitude of the output signal delivered from the acceleration detector 3 had decreased below the second set level $L_2$. In this regard, the delay in time of the output signal of the acceleration detector 3 differs greatly depending upon the direction of occurrence and the scale of occurrence of the earthquake and the individual character of the building. Therefore, the time of the automatic reset (the fixed period of time $T_1$) does not always become proper.

SUMMARY OF THE INVENTION

This invention has been made in order to solve the problem of the prior art as described above, and has for its object to provide an elevator control apparatus which can perform a reasonable automatic reset conforming to the scale of an earthquake.

An elevator control apparatus according to this invention performs automatic reset processing by evaluating a period of time in which the output signal of an acceleration detector expands from a first preset level to a second preset level, utilizing this period of time as earthquake information such as the scale or vibration frequency component of an earthquake and calculating on the basis of the information a period of time after which automatic reset is permitted.

In this case, accordingly, the automatic reset time of an elevator for any given earthquake can be predicted by the use of a microcomputer or the like during the occurrence of the earthquake, so that the optimum automatic reset can be effectively performed in accordance with that earthquake.

PREFERRED EMBODIMENT OF THE INVENTION

Figure 1:
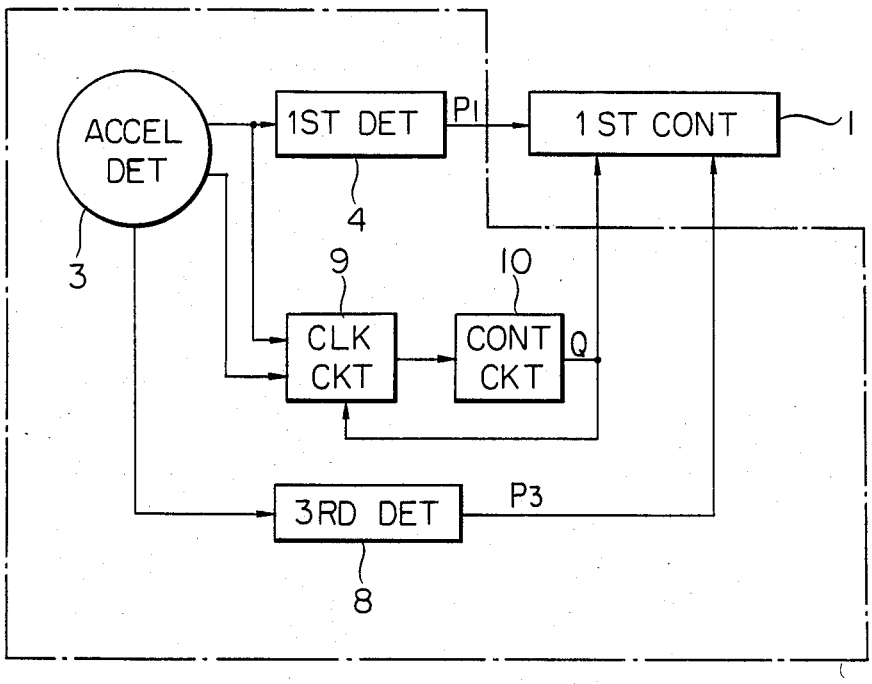
FIG. 1 is a block diagram of essential portions showing an embodiment of an elevator control apparatus according to this invention.
Figure 3:
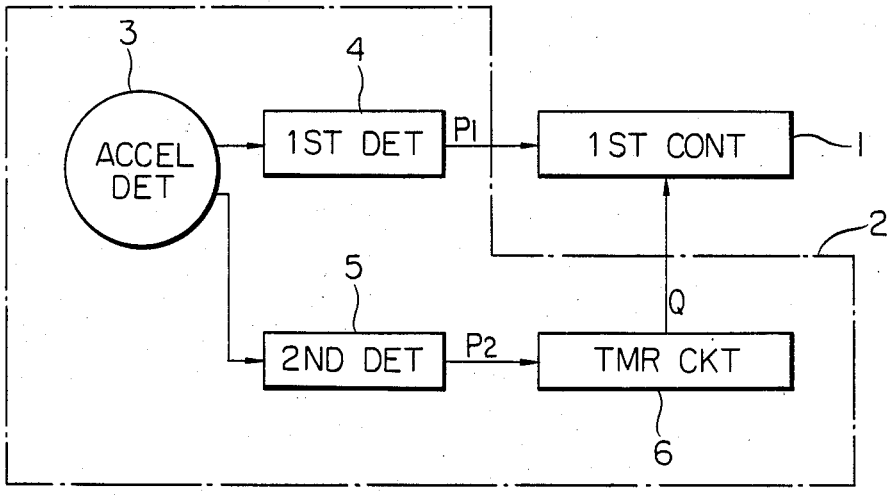
FIG. 3 PRIOR ART
FIG. 3 is a block diagram of essential portions showing an example of a prior-art elevator control apparatus.
Figure 4:
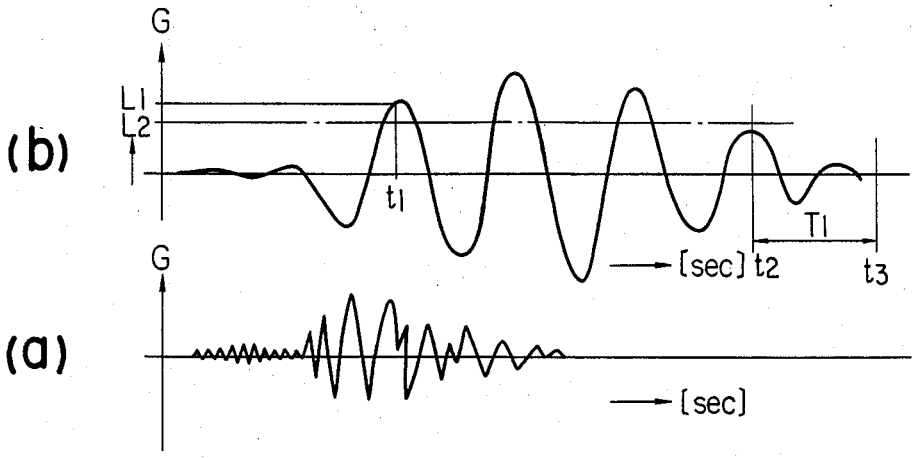
FIG. 4 PRIOR ART
FIG. 4 is an operating waveform diagram of the prior-art circuit shown in FIG. 3.

FIG. 1 is a block diagram which shows one embodiment of an elevator control apparatus capable of an earthquake mode operation according to this invention, and in which the same symbols as in FIG. 3 indicate identical or corresponding portions. In FIG. 4, numeral 7 designates a second control device which performs the earthquake mode operation by controlling the first control device 1 when an earthquake has occurred. When the output signal of the acceleration detector 3 has reached a third level $L_3$ which is above the first set level $L_1$ and at which the running of the cage of an elevator is dangerous, a third level detector 8 generates a third level detection signal $P_3$ and supplies it to the first control device 1, thereby to urgently stop the running of the cage. A timekeeping circuit 9 measures a period of time $T_2$ from the point of time $t_1$ at which the output signal of the acceleration detector 3 reaches the first set level $L_1$, till a point of time $t_4$ at which it reaches a fourth level $L_4$ that is several %–several tens % greater than the first set level $L_1$. A reset time prediction and control circuit 10 calculates a period of time necessary for reset, $T_3$ by executing an arithmetic process based on the timekeeping output signal of the timekeeping circuit 9 by means of a microcomputer or the like, and upon lapse of the resetting period of time $T_3$, it generates a time lapse signal Q and causes the first control device 1 to automatically reset the stoppage control of the elevator.

The circuit arranged as described above operates as will now be explained. When an earthquake as illustrated in (a) of FIG. 2 has occurred, the output signal of the acceleration detector 3 installed at the uppermost floor of a building becomes as shown in (b) of FIG. 2 by way of example because the characteristics of the building. When this output signal has reached the first set level $L_1$, the first level detector 4 generates the first level detection signal $P_1$ and supplies it to the first control device 1.

When supplied with the first level detection signal $P_1$, the first control device 1 stops the cage of the elevator at the nearest floor in accordance with the ordinary control as in the prior art. The timekeeping circuit 9 starts timekeeping at the point of time $t_1$ at which the output signal of the acceleration detector 3 has reached the first set level $L_1$ indicated in (b) of FIG. 2, and suspends the timekeeping operation at the point of time $t_4$ at which it has reached the fourth set level $L_4$, thereby to supply the measured result of the period of time $T_2$ to the reset time prediction and control circuit 10 as the timekeeping signal.

In this case, the timekeeping signal expresses the scale of the earthquake. Since the timekeeping signal indicates the scale of the earthquake, the reset time prediction and control circuit 10 executes an arithmetic process on the basis of this timekeeping signal, thereby to calculate the period of time required for the reset of the elevator, namely, the period of time $T_3$ required for the vibrations of the building to decay to a point of little or no influence on the running of the cage. Besides, the circuit 10 measures the calculated time interval $T_3$ since the point of time $T_4$.

Meanwhile, when the output signal of the acceleration detector 3 has reached the third set level $L_3$ at which the running of the cage of the elevator is dangerous, the third level detector 8 is actuated to generate the third level detection signal $P_3$ and supplies it to the first control device 1. When the first control device 1 is supplied with the third level detection signal $P_3$ before being able to stop the cage at the nearest floor in response to the first level detection signal $P_1$, it stops the cage immediately irrespective of the prescribed stop position, i.e., even at an intermediate position between floors, safe operation.

Figure 2:
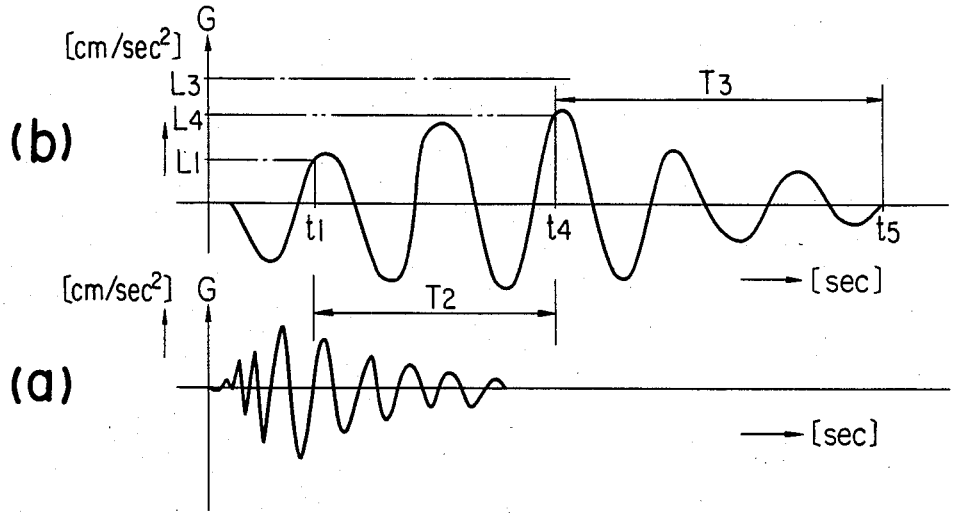
FIG. 2 is an operation waveform diagram for explaining the operation of the embodiment in FIG. 1.

Irrespective of whether or not the output of the acceleration detector 3 exceeds the third set level $L_3$ after exceeding the first set level $L_1$, when the timekeeping of the time interval $T_3$ in the reset time prediction and control circuit 10 has lapsed as indicated at a point of time $t_5$ in (b) of FIG. 2, the time lapse signal Q is generated and is supplied to the first control device 1. As indicated by the output signal of the acceleration detector 3 in (b) of FIG. 2, the vibrations of the building at the point of time of the generation of the time lapse signal Q are of a very small magnitude which exert very little influence on the running of the cage. As a result, the first control device 1 resets the stoppage control of the elevator in the normally stopped state at the nearest floor or in the urgently stopped state, and returns to the automatic control mode of operation of the elevator.

The uneasiness of passengers can be eliminated by using various announcements even during the suspension of electric power by incorporating a speech synthesizer with the reset time prediction and control circuit. This measure is remarkable especially when applied to an elevator for a very high building having an express zone. Various messages may well be delivered to the passengers of the cage by the use of displays.

Figure 1A:
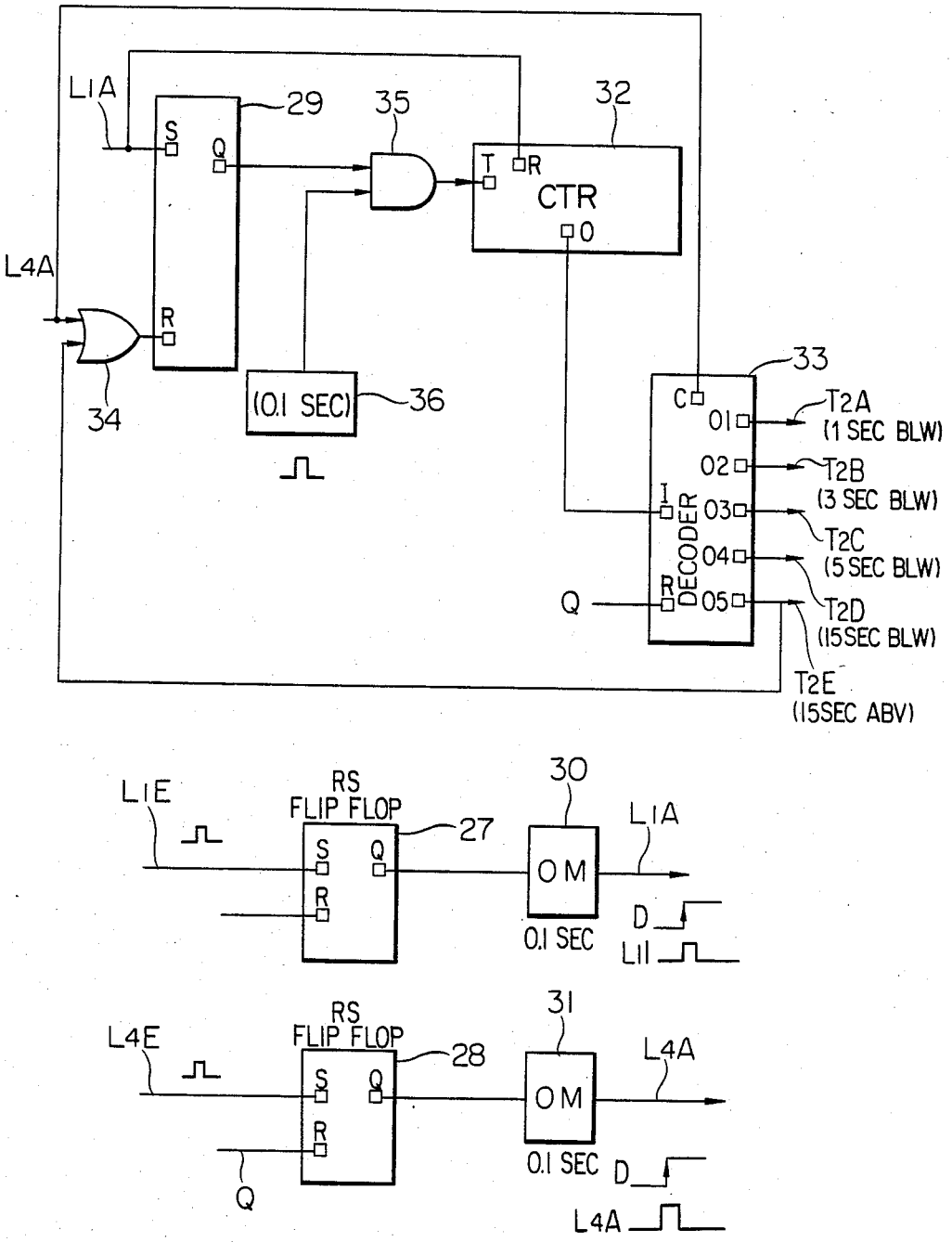
FIG. 1A is a diagram showing the arrangement of a timekeeping circuit for use in this invention.

Now, the details of the timekeeping circuit 9 will be described with reference to FIG. 1A. When a signal $L_1E$, which indicates that the output signal of the acceleration detector 3 has exceeded the first set level $L_1$, is generated, it is input to the set terminal S of an R-S flip-flop (R-S F/F) 27. Then, an output is provided from the terminal Q of the R-S F/F 27 and is applied to a one-shot multivibrator (OM) 30, which delivers a pulse signal $L_1A$ of 0.1 sec. This signal is applied to the set terminal S of an R-S F/F 29, the terminal Q of which provides an H ("high") output. The signal $L_1A$ is also input to the terminal R of a counter 32 to reset the count value thereof to zero.

An AND gate 35 is supplied with the Q output of the R-S F/F 29 and a clock pulse generated every 0.1 sec. by a clock pulse generator 36, thereby to supply an H output to the input terminal T of a counter 32 every 0.1 sec.

The counter 32 counts the pulse outputs of the AND gate 35 and supplies the count value from its output terminal Q to the input terminal I of a decoder 33.

It is assumed by way of example that, upon lapse of 4.5 sec. after the generation of the signal $L_1E$, the set terminal S of an R-S F/F 28 be supplied with a signal $L_4E$ which indicates that the output signal of the acceleration detector 3 has exceeded the fourth level $L_4$.

Then, the R-S F/F 28 produces an output from its terminal Q, and an OM 31 having received it delivers a signal $L_4A$ in the form of a pulse of 0.1 sec. This signal $L_4A$ is applied via an OR gate 34 to the reset terminal R of the R-S F/F 29, which renders the output of its terminal Q "low" (L). The signal $L_4A$ is also applied to the control terminal C of the decoder 33. Thus, the decoder 33 decodes the signal from the counter 32 and delivers a signal $T_2C$ from its terminal Q3 (because the signal $L_4E$ is generated 4.5 sec. later).

In a case where, after the generation of the signal $L_1E$, the earthquake detection level does not reach the fourth level $L_4$ and the signal $L_4E$ is not generated, the decoder 33 provides a signal $T_2E$ from its terminal Q5 when the signal supply from the counter 32 to the decoder 33 has continued for a predetermined time (set at, for example, 15 sec.). This signal $T_2E$ is supplied to the reset time prediction and control circuit 10 and is also applied to the OR gate 34. When the R-S F/F 29 receives the output of the OR gate 34 at the reset terminal R, it renders the output of the Q terminal L.

Likewise, a signal $T_2A$ is provided when the output of the counter 32 is less than 1 sec., a signal $T_2B$ is provided when it is less than 3 sec., and a signal $T_2D$ is provided when it is less than 15 sec.

The time lapse signal Q of the reset time prediction and control circuit 10 is applied to the reset terminals R's of the R-S F/F's 27 and 28 and the decoder 33 so as to reset these circuit elements. Thus, the timekeeping circuit 9 is prepared for an earthquake which might occur next.

The foregoing signals $L_1E$ and $L_4E$ are generated by comparators which, though not illustrated, compare the output of the acceleration detector 3 with the first set level $L_1$ and the fourth set level $L_4$ and deliver the compared results, respectively, or by circuitry equivalent thereto.

Figure 1B:
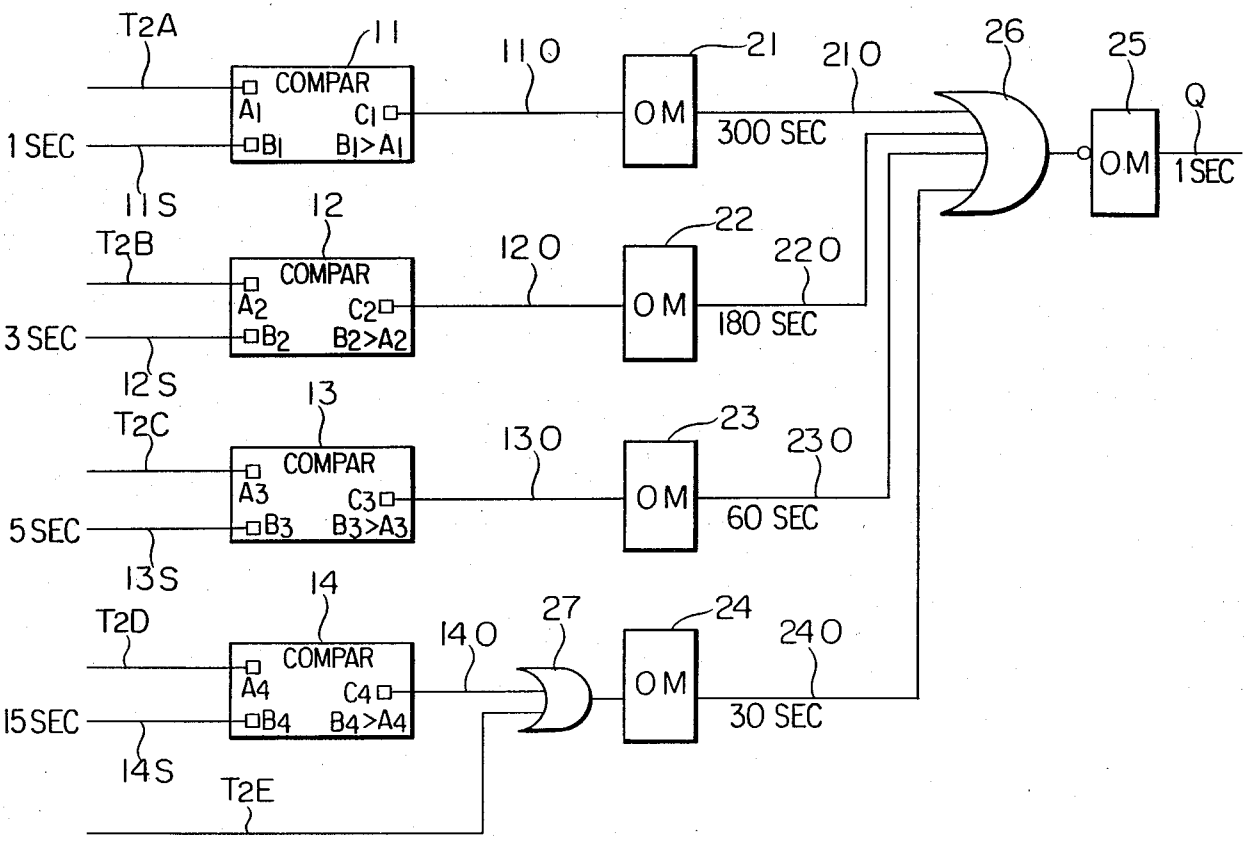
FIG. 1B is a diagram showing the arrangement of a reset time prediction and control circuit for use in this invention.

Next, the details of the reset time prediction and control circuit 10 will be described with reference to FIG. 1B.

The signal $T_2C$ delivered from the timekeeping circuit 9 is supplied to the input terminal $A_3$ of a comparator 13, in which the condition of the input 13S (5 sec.) of a terminal $B_3$> the input (less than 5 sec.) of the terminal $A_3$ holds. Thus, a signal 13Q appears at an output terminal $C_3$.

A one-shot multivibrator (OM) 23 is supplied with the signal 13Q. The OM 23 starts its output operation immediately, and outputs a signal 23Q for a period of time of 60 sec. set for this OM 23. The signal 23Q is applied to an OM 25 via an OR gate 26. The OM 25 is adapted to deliver a signal for 1 sec. when its input has changed from an H ("high") signal to an L ("low") signal. Accordingly, when the signal 23Q has become the L state upon the lapse of 60 sec., the OM 25 provides the time lapse signal Q for 1 sec. since that point of time. This signal Q is supplied to the first control device 1 as shown in FIG. 1, with the result that the stoppage control of the elevator is released. The signal Q is also supplied to the timekeeping circuit 9, which is then reset as described above.

When the signal $T_2E$ (indicating at least 15 sec.) is received from the timekeeping circuit 9, it is applied to an OM 24 through an OR gate 27. In this way, the time lapse signal Q is generated by the OR gate 26 and the OM 25 after 30 sec. without performing the operation of acknowledging the establishment of a condition in a comparator.

Comparators 11, 12 and 14 operate similarly to the comparator 13. That is, the comparator 11 compares the input (signal $T_2A$: less than 1 sec.) of a terminal $A_1$ with the input (signal 11S: 1 sec.) of a terminal $B_1$, the comparator 12 compares a terminal-$A_2$ input (signal $T_2B$: less than 3 sec.) with a terminal-$B_2$ input (signal 12S: 3 sec.), and the comparator 14 compares a terminal-$A_4$ input (signal $T_2D$: less than 15 sec.) with a terminal-$B_4$ input (signal 14S: 15 sec.). Subject to the B-terminal input> the A-terminal input, the comparators provide signals 11Q, 12Q and 14Q respectively.

OM's 21 and 22 provide a signal 21Q of 300 sec. and a signal 22Q of 180 sec. when supplied with the input signals 11Q and 12Q, respectively.

As described above, according to this invention, a period of time since the output signal of an acceleration detector exceeds a first set level, until it reaches a second set level greater in value than the first set level, is measured, a calculation is executed on the basis of the measured period of time thereby to predict the scale of an earthquake, and a reset control is performed after a predicted period of time necessary for reset. This brings forth the geature that an automatic reset time can be set according to the earthquake so as to effectively perform the automatic reset.

What is claimed is:

1. An elevator control apparatus having a first control device for controlling ordinary operation of an elevator, and a second control device for controlling the first control device in an earthquake mode at the time of occurrence of an earthquake; said second control device comprising an acceleration detector installed in a high part of a building for detecting the acceleration of vibration of the elevator and generating an output signal representative thereof, a first level detector for sensing the output signal of said acceleration detector so as to cause said first control device to stop the operation of the elevator at a nearest floor when the output signal of said acceleration detector exceeds a first set level, timekeeping means for measuring a period of time from which the output signal of said acceleration detector increases from the first set level to a second set level higher than the first set level by a predetermined value, reset time prediction means for calculating on the basis of the measured time period an estimated period of time required for the output signal of said acceleration detector to decrease to a level having no influence on the operation of the elevator, and control means for generating a control signal upon lapse of the estimated time period so as to reactivate the control of said first control device to continue the operation of the elevator.

2. An elevator control apparatus according to claim 1 wherein said second control device further comprises a third level detector for sensing the output signal of said acceleration detector so as to immediately stop the operation of the elevator irrespective of the stop positions of floors when the output signal of the acceleration detector exceeds a third set level higher than the second set level.

3. An elevator control device according to claim 1 wherein said reset time prediction means executes the predictive calculation so as to lengthen the estimated period of time as the measured period of time provided from said timekeeping means decreases.

4. An elevator control apparatus according to claim 1 wherein when the measured period of time provided from said timekeeping means reaches a predetermined value, said reset time prediction means selects a preset time interval as the estimated time period.

5. An elevator control apparatus according to claim 1 wherein said timekeeping means is reset after each estimation performed by said reset time prediction means.

* * * * *